United States Patent [19]

Weigl

[11] 4,128,256

[45] Dec. 5, 1978

[54] SKI BRAKE

[75] Inventor: Erwin Weigl, Brunn am Gebirge, Austria

[73] Assignee: TMC Corporation, Zug, Switzerland

[21] Appl. No.: 786,377

[22] Filed: Apr. 11, 1977

[30] Foreign Application Priority Data

Apr. 23, 1976 [AT] Austria ..... 3004/76

[51] Int. Cl.[2] ..... A63C 7/10

[52] U.S. Cl. ..... 280/605

[58] Field of Search ..... 280/605, 604

[56] References Cited

U.S. PATENT DOCUMENTS

| | | | |
|---|---|---|---|
| 3,964,760 | 6/1976 | Riedel | 280/605 |
| 3,989,271 | 11/1976 | Riedel | 280/605 |
| 4,014,563 | 3/1977 | Weigl et al. | 280/605 |

*Primary Examiner*—David M. Mitchell

*Attorney, Agent, or Firm*—Blanchard, Flynn, Thiel, Boutell & Tanis

[57] ABSTRACT

An improved ski brake having a pair of blade members which extend laterally with respect to the ski and are pivotally supported against spring force about an axis which extends transversely with respect to the longitudinal axis of the ski. The two blade members are connected through a stepping plate and are held in the downnhill retracted position above the sliding surface of the ski by the force of the ski boot pressing downwardly thereon. The ski brake is composed of a section of spring steel wire having two portions thereof bent at 180° to form the blade members. The ends of the spring steel wire are received in flanges on a base plate secured to the ski, which flanges have control cam surfaces thereon and which terminate in a locking recess. The ski brake is held in the braking position when the end portions of the spring steel wire are located in the locking recess.

7 Claims, 4 Drawing Figures

SKI BRAKE

FIELD OF THE INVENTION

The invention relates to a ski brake having two wings or blade members which extend laterally with respect to the ski and each are pivotally supported against a spring force about an axis which extends transversely with respect to the longitudinal axis of the ski, wherein the two wings are connected by a stepping plate and through which the ski brake is held in the downhill position, namely the retracted position above the ski by the ski boot.

BACKGROUND OF THE INVENTION

A ski brake of the abovementioned type is described, for example, in U.S. Pat. No. 3,083,028, issued Mar. 26, 1963. In this known ski brake the blade members are loaded by a spring, for example, a helical or torsion spring. A disadvantage of this known construction lies in the two blade members forming with the connecting bar on one side and the two springs on the other side are separate parts. In addition, in the known construction, the brake part and the stepping plate are made of a flat material, for example of sheet metal. For this reason, the two pivot axes are then additionally to be designed separately which causes the braking wing to receive a form which can be produced only with increased expense.

On the other hand, a ski brake is also known which consists of spring steel wire. Such a brake is described, for example, in U.S. Pat. No. 4,014,563, issued Mar. 29, 1977 and assigned to the same assignee as is the present subject matter. This construction has again the disadvantage that each brake leg or blade member must each be constructed with two extensions in order to be able to form on the one side a guideway on the holding plate and on the other side a support for a stepping plate. In spite of this compact structure, which overcomes the disadvantages of earlier similar ski brakes, in reality deformations still occur which apparently are caused by construction and cannot be avoided in totality.

The objects of the invention are to design a simple ski brake so that neither separate springs nor two extension pairs are needed. Starting out from a ski brake of the abovementioned type, the objects are inventively achieved by the entire ski brake consisting in a conventional manner of a barlike spring steel wire, wherein the two swivelling blade members are each constructed of two sections of the spring steel wire, the wire being bent at 180° at the free end of the blade member, and wherein the two springs are each formed by one bent end of the spring steel wire, which ends are guided under pretension on a control cam which extends in longitudinal direction of the ski, and wherein the control cam has at least one locking position, in which the blade members are held in the braking position.

The two ends of the barlike formed ski brake therefore do not only form the pivot axes of the wings, but also the resilient part of the same. By using a control cam, a braking position both forwardly and also backwardly is achieved. This means that the ski brake is effective even when the ski would be freely sliding on a hill with the tail thereof pointing downhill.

A particularly advantageous embodiment of the inventive ski brake consists in that the bent portions of the two ends of the spring steel wire each form with the associated pivot axes one acute angle. This embodiment is of importance for adjusting the desired initial tension.

BRIEF DESCRIPTION OF THE DRAWINGS

Further advantages and details of the inventive ski brake will now be described more in detail with reference to the drawings which illustrate one exemplary embodiment.

In the drawings:

FIGS. 1 and 2 illustrate the inventive ski brake in associated views while in the braking position, wherein FIG. 1 is a side view and FIG. 2 is a top view;

DETAILED DESCRIPTION

Figure 1:
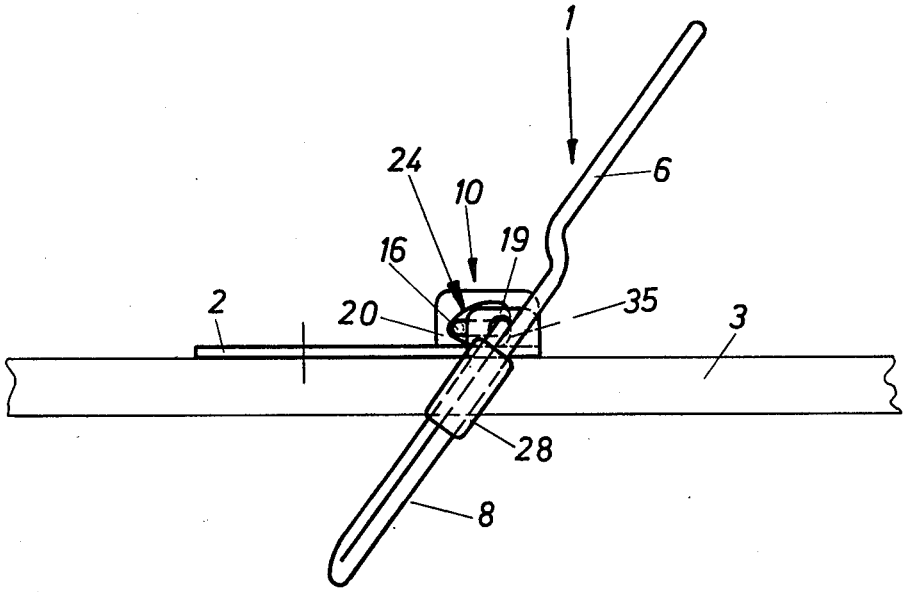

The ski brake which is identified as a whole by reference numeral 1 is secured by means of a base plate 2 on the upper surface of a ski 3 by means of screws 4. As can particularly be recognized in the top view of FIG. 3, the ski brake 1 has an approximately U-shaped design. It can also be recognized from FIG. 3 that the ski brake 1 is held in the ready or downhill position by means of a ski boot 5 which is only partially indicated in broken lines.

Figure 2:
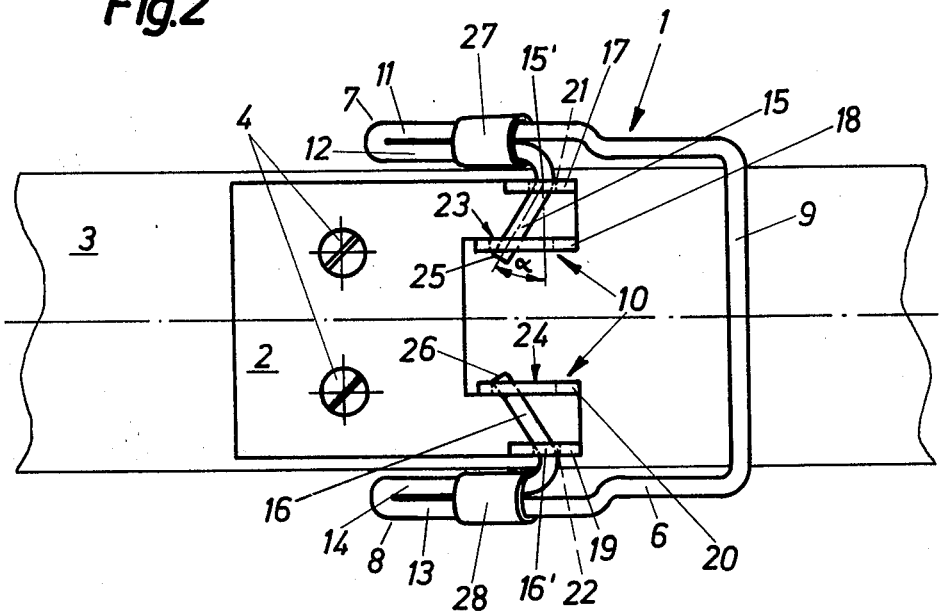
Figure 3:
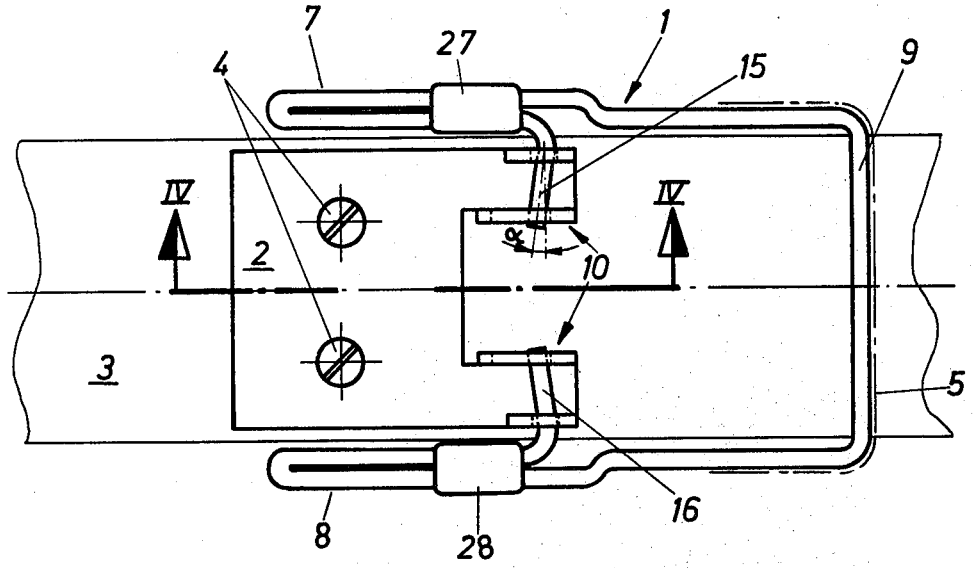
FIG. 3 illustrates the ski brake in the cocked and ready position (downhill position) with the ski boot being only indicated in broken lines.

The ski brake 1 consists in the present exemplary embodiment of one single U-shaped spring steel wire 6. The two wings or blade members 7,8 and the bight part 9 which connects the blade member are illustrated in FIGS. 2 and 3. Each blade member 7,8 is constructed of two sections 11,12 or 13,14 of the spring steel wire 6, which sections are bent back at 180° at the free end of the blade members. The sections 12 and 14 of the spring steel wire 6, which parts lie closer to the ski 3 than the sections 11 and 13 are bent adjacent their end portions 15,16. The two end portions 15,16 are held in a mounting 10 which is formed out of the base plate 2. The mounting 10 includes two sets of laterally spaced, upwardly extending flanges 17,18 or 19,20. The two flanges 17 and 19 each contain thereon a bearing point 21,22 which receives the associated axle part 15' or 16' of the two end portions 15,16. The two other upwardly extending flanges 18 or 20 each contain a control cam 23 or 24 thereon which will be discussed more in detail below.

The terminal ends 25,26 of the two end portions 15,16 are received in and guided in the two control cams 23,24. The two sections 11 and 12 on the one side or the two sections 13 and 14 on the other side, which sections are bent back at 180°, are each held together by one retainer clip 27,28.

Figure 4:
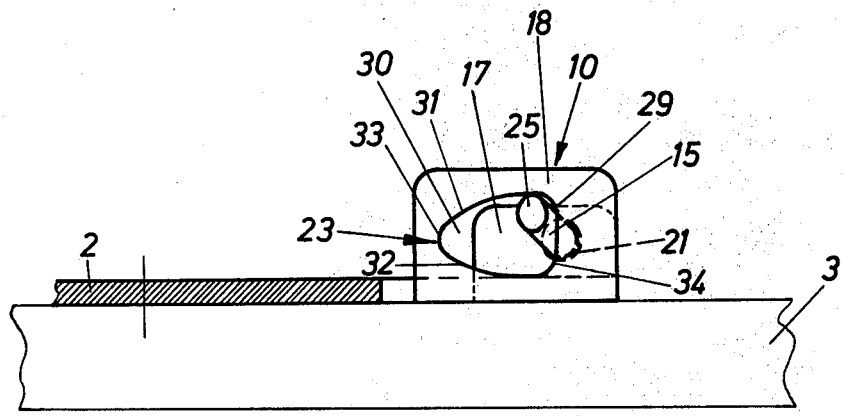
FIG. 4 is a detailed cross-sectional view taken along the line IV—IV of FIG. 3.

As can particularly be recognized from FIG. 4, the control cam 23 is formed by the edge of an approximately heart-shaped recess 30. The control cam 23 has rising and dropping surfaces 31 or 32, which converge in a locking recess portion 33. The end 26 of the end portion 16 is in FIG. 1 received in the locking recess portion 33; according to FIG. 4 the end 25 engages the rising surface 31 of the control cam 23. The structure and design of the control cam 24 corresponds obviously to the control cam 23.

In addition, it will be recognized from FIGS. 2 and 3 that the bent end portions 15,16 of the spring steel wire 6 each form with the associated swivel axes 23 or 24 one acute angle $\alpha$. A comparison of FIGS. 2 and 3 clearly shows that the angle $\alpha$ is reduced during the swinging of the blade members 7,8 from the braking position into the ready or downhill position. In this manner it is assured that the initial tension of the spring steel wire 6 increases in the end portion 15,16, so that after release of the ski brake 1 by releasing the ski boot 5, a swivelling caused by the spring force occurs and the ski brake 1 is moved into the position shown in FIG. 1.

The design of the two control cams 23,24 according to FIG. 4 assures that a swivelling also occurs along the dropping surface 32 on the control cam 23 (and accordingly also on the not shown dropping surface on the control cam 24). It is furthermore conceivable to limit the free movement of the blade members 7,8 at least by one, preferably by two stops 34,35. Through this an undesired turning aside of the blade members 7,8 is prevented.

Further modifications are possible without departing from the scope of the invention. For example, the individual edge parts of the control cam can be manufactured of different materials of different sliding characteristics, or can be provided with coatings of such materials. Also the two bearing points may have good sliding characteristics, through which the swivelling capability of the ski brake is improved.

The two blade members can be provided with a coating or can be sprayed with plastic which, if necessary, has one or several teeth to increase the braking action. In this case, it is possible to reduce the stength of the chosen spring steel wire up to the admissible limit.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a ski brake having two blade members each pivotally mounted on a mounting plate attached to the upper surface of a ski for movement between a braking position wherein said blade members extend transversely of and below the bottom surface of said ski and a retracted position wherein said blade members extend above said upper surface of said ski, the improvement comprising wherein said two blade members are formed from a spring steel wire bent into a U-shape having a pair of legs and a bight portion, said legs of the U forming said two blade members, said spring steel wire being bent back upon itself in each of said two blade members 180° with the terminal end portions of said wire in each of said two blade members being bent inwardly toward each other to form axially aligned axles and end sections extending at an acute angle to the axis of said axles and to a plane defined by said U-shaped wire, wherein said mounting plate has means thereon operatively supporting said axles to render said two blade members pivotal with respect to said ski and control cam means having a contoured surface operatively engaging each of said end sections and flexing said end sections away from a normal relaxed position thereof, said contoured surface having a first segment engaging said end sections when said two blade members are in said braking position, said first segment being sufficiently spaced from said axis so that said wire is flexed the least when in said braking position, said contoured surface having a second segment which is spaced closer to said axis than said first segment to effect a maximum flexing and consequent torsioning of said wire when said two blade members are pivoted to said retracted position, said end sections sliding along said contoured surface between said first and second segments during a pivoting of said two blade members between said braking and retracted positions.

2. The improved ski brake according to claim 1, wherein said axles extend at generally a right angle to each of said two brake members.

3. The improved ski brake according to claim 1, wherein said contoured surface extends parallel to the longitudinal axis of said ski.

4. The improved ski brake according to claim 1, wherein said control cam means includes a pair of laterally spaced and parallel contoured surfaces, each operatively engaging a respective one of said end sections.

5. The improved ski brake according to claim 1, wherein said first segment includes a recessed portion in said contoured surface which effects upon receiving said end sections therein a releasable locking of said two brake members in said braking position.

6. The improved ski brake according to claim 5, wherein said contoured surface of said control cam means is formed by the peripheral edges of a generally heart-shaped opening in a flange on said mounting plate, said peripheral edges converging to form said recessed portion.

7. The improved ski brake according to claim 6, wherein the free movement of said two blade members is limited in one direction of movement thereof at least by a third segment of said peripheral edges, said upper surface of said ski limiting the movement of said two brake members in the other direction of movement thereof.

* * * * *